US008661594B2

(12) United States Patent
Hui et al.

(10) Patent No.: US 8,661,594 B2
(45) Date of Patent: Mar. 4, 2014

(54) CLEANING APPARATUS FOR POOL CLEANING VEHICLE WITH ENDLESS LOOP TRACK

(75) Inventors: Wing-kin Hui, Hong Kong (HK); Wing-tak Hui, Hong Kong (HK)

(73) Assignee: Multi Wisdom Limited, Hong Kong (HK)

( * ) Notice: Subject to any disclaimer, the term of this patent is extended or adjusted under 35 U.S.C. 154(b) by 29 days.

(21) Appl. No.: 12/939,079

(22) Filed: Nov. 3, 2010

(65) Prior Publication Data

US 2012/0102665 A1 May 3, 2012

(51) Int. Cl.
*E04H 4/16* (2006.01)

(52) U.S. Cl.
USPC ..... 15/1.7

(58) Field of Classification Search
USPC ..... 15/1.7, 52.1, 347, 383
See application file for complete search history.

(56) References Cited

U.S. PATENT DOCUMENTS

| | | | | | |
|---|---|---|---|---|---|
| 3,979,788 | A * | 9/1976 | Strausak | ..... | 15/1.7 |
| 5,245,723 | A * | 9/1993 | Sommer | ..... | 15/1.7 |
| 5,799,351 | A * | 9/1998 | Rief et al. | ..... | 15/1.7 |
| 6,155,657 | A * | 12/2000 | Erlich et al. | ..... | 305/178 |
| 6,212,725 | B1 * | 4/2001 | Porat | ..... | 15/1.7 |
| 7,117,554 | B2 * | 10/2006 | Pichon | ..... | 15/1.7 |
| 2006/0265820 | A1 * | 11/2006 | Erlich et al. | ..... | 15/1.7 |
| 2009/0183328 | A1 * | 7/2009 | King | ..... | 15/143.1 |

* cited by examiner

*Primary Examiner* — Robert Scruggs
(74) *Attorney, Agent, or Firm* — Peninsula IP Group; Douglas Chaikin

(57) ABSTRACT

Disclosed herein is cleaning structure attachable to a submersible pool cleaning vehicle (PCV). In one exemplary embodiment the PCV has an endless loop track and a chassis therefore. The cleaning structure attaches to the chassis and acts as a cap covering the drive wheels and track. The cleaning structure includes a base and bristles extending outwardly therefrom. The bristles define fingers. In one embodiment, the fingers are of a uniform length. In another embodiment, the fingers are of a graduated length. Others embodiments include the fingers being distributed on the base in a random pattern.

In one embodiment, the cleaning structure defines a single insert. In another, the cleaning structure includes multiple inserts.

10 Claims, 3 Drawing Sheets

CLEANING APPARATUS FOR POOL CLEANING VEHICLE WITH ENDLESS LOOP TRACK

RELATED APPLICATIONS

This application is related to application Ser. No. 12/1272,730, filed by co-inventor, Wing-kin HUI, for POOL CLEANING VEHICLE WITH ENDLESS LOOP TRACK, filed on Nov. 18, 2008. This application is specifically incorporated herein and is to be used for all purposes consistent with incorporation by reference.

FIELD OF THE INVENTION

This invention generally relates to the field of automated pool products. More particularly, this invention relates to structure attachable submersible automated swimming pool cleaning vehicle (PCV) for facilitating thorough cleaning of the pool water and pool surfaces. More particularly, this invention relates to devices and cleaning structure used in cooperation with a PCV having an endless loop track drive and wherein such cleaning structure is attachable to the PCV.

BACKGROUND OF THE INVENTION

It is well accepted that submersible automated pool cleaning devices, such as self propelled pool cleaning vehicles (PCV's) are essential to the proper maintenance of a pool, whether the pool be above or below ground. The typical vehicle includes a housing and drive members. The drive members attach to the housing usually through connection to a chassis. Drive members include wheels, endless loop tracks and combinations of each. Additionally, vehicles have included two and four wheel drive vehicles in various combinations and variations. In the case of a belt or endless loop track, the track wraps around the drive and/or idler wheels or rollers.

It will be appreciated that such vehicles may also have some combination of wheels and/or rollers and the vehicle may also be a two or four-wheel drive vehicle. The endless loop track may be fitted over any combination of two or four wheel drive vehicles. Such tracks have been found to be an effective means for moving the vehicle around the surface of the pool while the vehicle is submerged.

Of course, the primary purpose for all PCV's is to clean the pool and pool water. In order to properly maintain clean, pool water, the water itself as well as the pool surfaces must be cleaned and kept clean. It is imperative to keep the pool surfaces free from the build up of dirt and debris. Once dirt and/or debris is allowed to settle in on the pool surface, algae forms. Marge enough build-up of such algae can cause the pool pH to become unbalanced and the pool water unstable, in terms of cleanliness.

Sometimes drastic efforts caused by "dirty" water result in the entire contents of the pool being drained and starting again. As can be appreciated this is an expensive and time consuming process. Additionally, without thorough cleaning and maintain, the situation will simply be repeated. There is no guarantee, without proper maintenance methods, that the water will not simply revert to the same "dirty" condition.

Of special concern in this regard, is the fact that embedded particles can be particular concern. As noted by others, these embedded particulates can cause fatal consequences in term of "dirty water" requiring the emptying of the pool for dry cleaning. Clearly, a condition that is primary to avoid.

Clearly, there is a strong industry-wide need to prevent the build up of particulates in the pool water. There is even a stronger need to prevent the embedding of such particulates in the surface of the pool. Cleaning each and every square millimeter of the pool's surface is simply not a practical solution. Therefore, Applicant has developed a structure for using the automated pool cleaning vehicle to remove even embedded particulates in the surface of the pool. Additionally, the cleaning structure, in accordance with the invention, facilitates the PCV to thoroughly clean the dirt and debris thus dislodged from the pool's surface. This not only serves the short term goal of keeping the water clean and free from dirt and debris, but also is helpful in accomplishing the long term goal of preventing the build up of such particulates on and in the surface of the pool.

What is needed is cleaning structure for a submersible automated pool cleaning vehicle (PCV), which is adapted to clean the pool surface by dislodging dirt and debris from the surface of the pool and further to dislodge even embedded dirt and debris from the surface of the pool using the automated motion of the PCV.

SUMMARY OF THE INVENTION

The cleaning structure, in accordance with the present invention, is connected to a pool cleaning vehicle (PCV) having a track drive. The cleaning structure is attached to the chassis of the PCV and therefore, it can also be used with PCV's without a track drive. In effect, the cleaning structure acts as a cap for the drive wheels and when present, the track of the PCV. As the PCV with the cleaning structure in accordance with the invention, moves about the pool surface, the cleaning structure runs into the pool walls and obstacles and obstructions in the pool dislodging dirt and debris so that the PCV can suck up the same.

It is an object of this invention is to provide cleaning structure attachable to the PCV through the chassis of the track drive for thoroughly cleaning a pool.

It is an additional object of this invention to provide such cleaning structure, which is attachable to a PCV and thereby uses automated means to dislodge dirt and debris from the pool surface.

It is an additional object of this invention to provide such cleaning structure, which is attachable to a PCV and thereby uses automated means to dislodge dirt and debris embedded in the pool surface.

In accordance with the objects set forth above and those that will be described hereinafter, the cleaning structure in accordance with this invention is attachable to the PCV having an endless loop track and the cleaning structure being attachable to the track, the vehicle with the cleaning structure comprising:

the PCV having a chassis for the endless loop track, which has an exterior and an interior;

cleaning inserts attachable to the chassis, the cleaning inserts having a base and having a plurality of bristles, the bristles outwardly extending from the base and the endless loop track; and means for connecting the cleaning inserts to the chassis, whereby, as PCV moves around the pool surface the bristles contact the surface of the pool and dislodge dirt and debris to facilitate thorough cleaning of the pool.

In another exemplary embodiment, the vehicle in accordance with this invention has a track drive, which includes the drive members and associated members for moving the vehicle having a series of ridges with the same pitch as the track ribs.

In an exemplary embodiment, the cleaning structure in accordance with this invention includes a single insert.

In another exemplary embodiment, the cleaning structure in accordance with this invention has multiple inserts.

In another exemplary embodiment, the cleaning structure in accordance with this invention, the bristles include fingers and the fingers are of the same length. In a related embodiment, the fingers are of a graduated length. In other embodiments, the fingers have a uniform pattern and in other embodiments, a random pattern.

It is an advantage of the invention to provide cleaning structure, which attaches to a pool cleaning vehicle, which moves about the pool in an automated fashion to dislodge particulates from the surface of the pool.

It is an advantage of the invention to provide cleaning structure which attaches to a pool cleaning vehicle which moves about the pool in an automated fashion to dislodge particulates embedded in the surface of the pool.

BRIEF DESCRIPTION OF THE DRAWING

For a further understanding of the objects and advantages of the present invention, reference should be had to the following detailed description, taken in conjunction with the accompanying drawing, in which like parts are given like reference numerals and wherein.

DETAILED DESCRIPTION OF THE INVENTION

Figure 1:
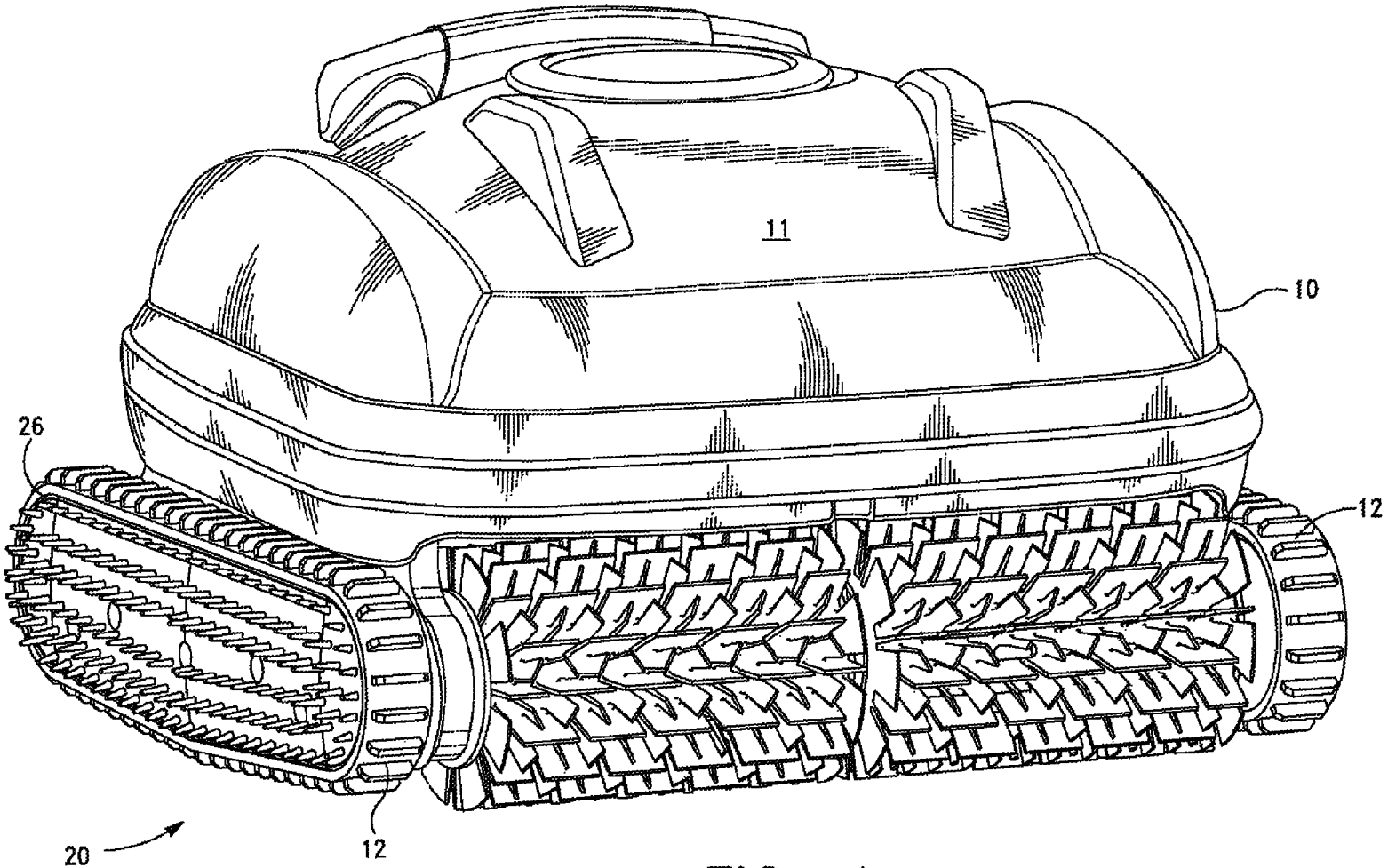
FIG. 1 is a perspective view of a pool cleaning vehicle having the cleaning structure in accordance with this invention attached to the PCV.

With respect to FIG. 1 there is shown an exemplary embodiment of the submersible pool cleaning vehicle (PCV) 10 having the cleaning structure in accordance with this invention generally denoted by the numeral 20. The cleaning structure 20 is mounted to the tracks of the. PCV 10.

The PCV 10 includes a housing 11 and a chassis for the drive tracks 12. Attached to the chassis are drive tracks 12. The drive tracks 12 define an endless loop drive belt or track and in various exemplary prior art embodiments overlap drive wheels (not shown). For further information and background concerning endless loop track PCV's, Applicant has specifically incorporates U.S. application Ser. No. 12/272,730 hereto. Further, the full extent of the disclosure therein is read into this specification and specifically into the Detailed Description of the Invention herein.

Figure 2:
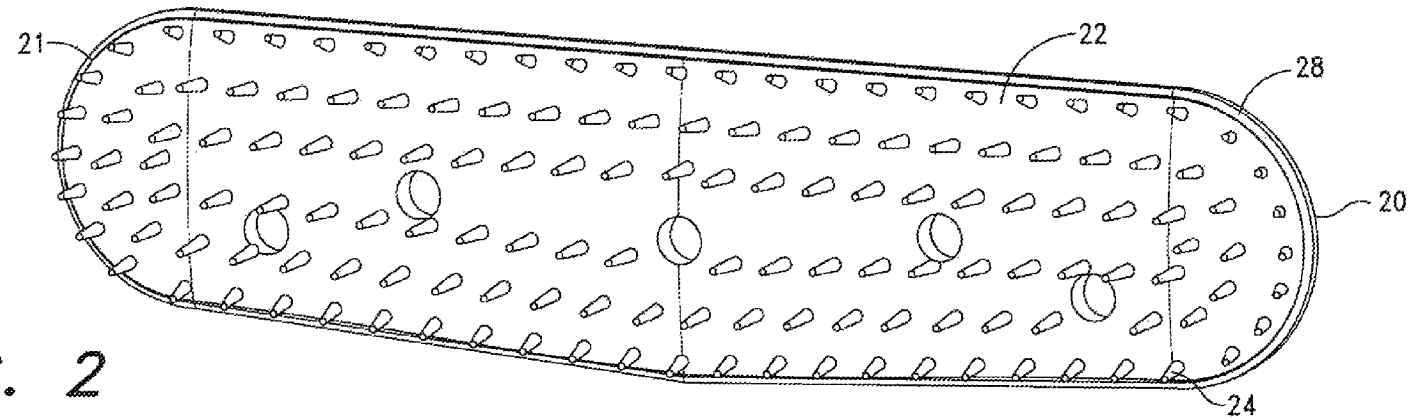
FIGS. 2 is side perspective view of an exemplary embodiment of the cleaning structure in accordance with this invention illustrating bristles defining fingers, where the fingers are of approximately the same length.

As shown in FIG. 2, the cleaning structure 20 defines an insert 21 and includes a base 22. Extending from the base 22 are bristles 24. The bristles 24 extend outwardly from the base 22. As the PCV moves around the pool, the bristles 24 run into the side walls and objects extending from the pool surface, such as stairs and the like. As the bristles run in the pool surfaces and side walls, dirt and debris are dislodged, allowing the PCV to suck up the same.

The bristles 24 define fingers. In the embodiment shown in FIG. 2, each of the fingers is approximately the same size. As will be described below, the fingers can be of different lengths, randomly selected or organized in some fashion as noted with respect to FIGS. 3 & 4. Each of these embodiments is within the spirit and scope of the invention.

The cleaning structure 20 is attached to the chassis for the track 12. The exterior of the chassis track 12 includes an inside race 26. The base 22 of the insert 21 has a compatible outside, race 28. Each of the races 26 and 28 is compatible and when pressed together form a force fit. The force fit is strong enough to withstand bumping into walls and obstructions and obstacles on the pool surfaces. While there is flexibility in the fingers, the fingers are strong enough to dislodge particles and dirt and even embedded particulates. The fingers also serve, to some extent as shock absorbers, allowing the force fit to the tracks to be maintained despite repeated such contacts and even, collisions with the pool surface. In effect, the cleaning structure acts as a cap of the drive wheels and track.

The insert 21 is generally of a relatively soft engineering plastic. However, the insert 21 while being flexible is also durable and the fingers are likewise durable and flexible. The fingers are flexible enough to bend and yet durable enough not to break off even after repeated contacts and collisions with the various pool surfaces.

Figure 3:
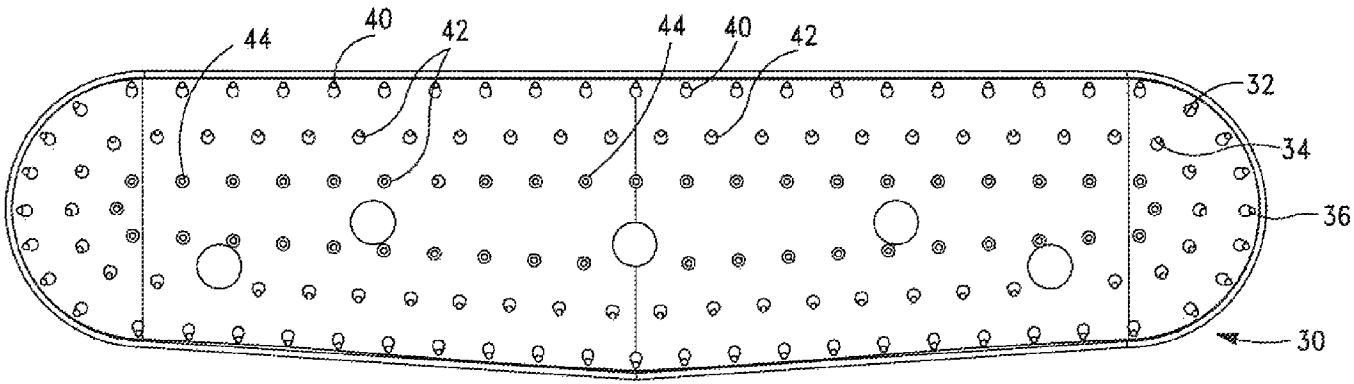
FIGS. 3 & 4 illustrates another exemplary embodiment of the cleaning structure in accordance with this invention, where the fingers are of a graduated length.
Figure 4:
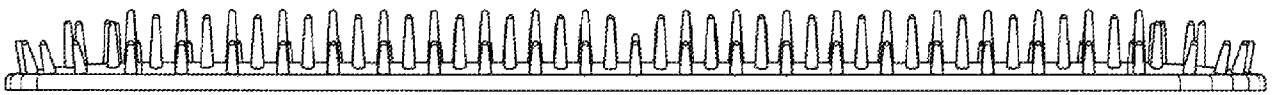

With respect to FIGS. 3 & 4, there is shown another embodiment of the cleaning structure in accordance with the invention, generally designated by the numeral 30. In this embodiment, the insert 32 defines bristles 34 comprising fingers 36. The fingers 36 are of graduated length. The row of fingers 40 are shorter than the row of fingers 42. Likewise the row of fingers 42 are shorter than the row of 44.

Thus, in the exemplary embodiment of FIGS. 3 & 4, the center-most row of fingers 44 is the longest and the outer most row of fingers 40 is the shortest. As noted above, the finger length could be random or organized in other ways than graduated, all within the spirit and scope of the invention.

The means and structure for attachment of the cleaning structure 30 of FIGS. 3 & 4 are the same as previously described with respect to FIGS. 1 & 2. The same force fit through the races as set forth above works equally well for the graduated length embodiment described with respect to FIGS. 3 & 4.

Figure 5:
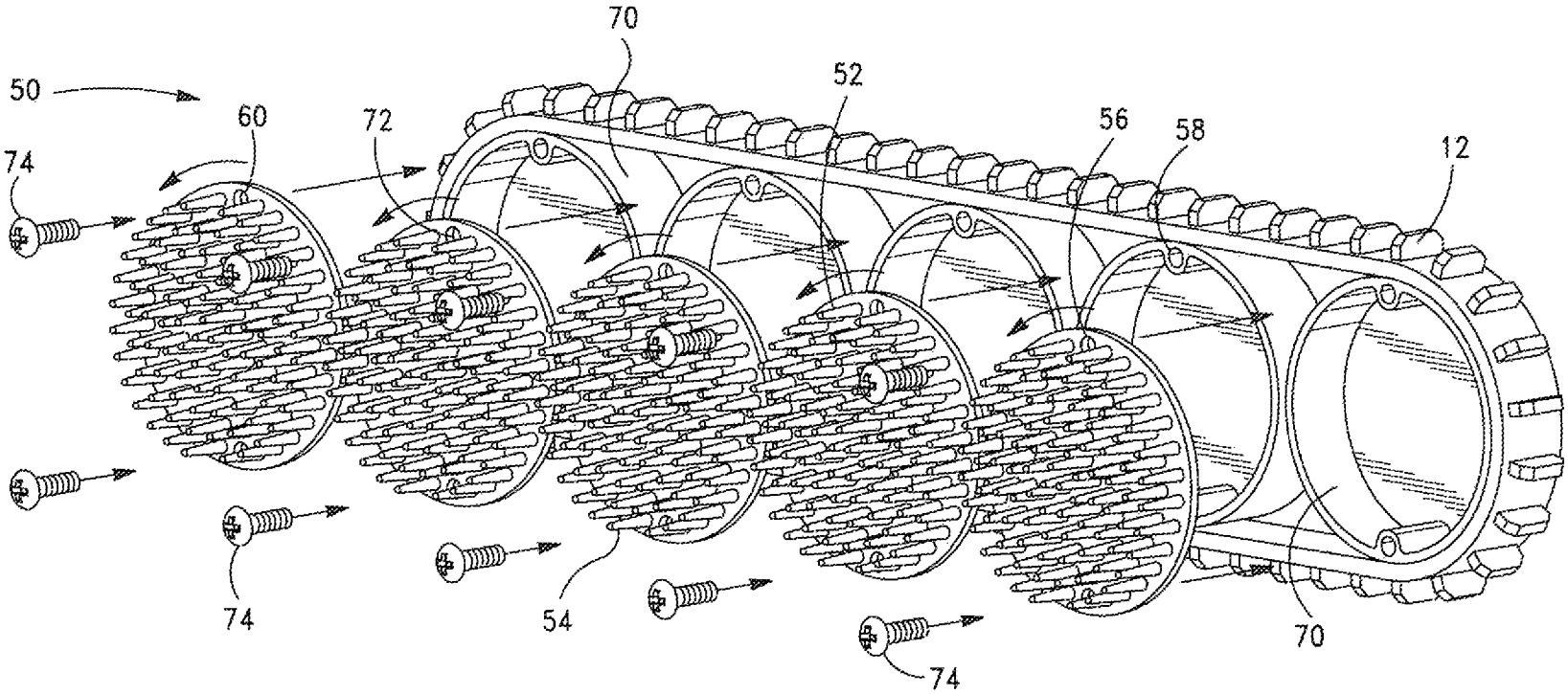
FIG. 5 illustrates a multiple insert exemplary embodiment of the cleaning structure in accordance with this invention.

With particularly reference to FIG. 5, there is shown the multiple insert embodiment of the cleaning structure, generally designated by the numeral 50. The cleaning structure 50 includes four identical inserts 52. Each of the inserts 52 has a series of bristles 54. The bristles 54 comprise fingers 56.

The fingers 56 as well as the inserts 52 generally conform to the standards and functions described previously with respect to the form and function of the earlier embodiments. Likewise, the finger length and pattern of placement of the fingers on the insert can be random or organized and the description previously set forth is equally applicable to this embodiment.

Likewise the material from which the fingers 56 are made conforms to the same standards and functions in a manner consistent with that previously described. Each of the inserts 52 includes flexible and durable fingers just as described previously. Also as described above, the inserts 52 are attached to the track 12. The means and structure for attachment of each of the inserts. 52 to the track 12 include the track 12 having female connector members 58. Additionally, the inserts 52 include male connection members 60. The male members 60 are force fit to the female members 58 and form a force fit connection.

As with the force fit connection described with reference to the earlier embodiments illustrated in FIGS. 1-4, the force fit connection here is also capable of withstanding repeated collisions with the walls of the pool as well as irregular and objections, structures and obstructions on the pool surface. The collisions allow the fingers to engage the surface of the pool and thereby dislodge dirt and debris that may have attached itself to the pool surface or may have even become embedded therein. In so dislodging such dirt and debris, the PCV is then able to suck up the same and thereby clean the water thoroughly.

Additionally, as illustrated in the FIG. 5, the attachment structure includes the chassis of the endless loop track 12 having an insert holder 70 for each insert 52. In this embodiment, each of the male members 60 has an opening 72 through its center. The opening 72 is large enough to allow a screw 74 to be inserted therethrough. Consistent with this embodiment, the insert holder 70 has a screw receiving member, defining a female opening 76, which in other exemplary embodiments has screw threads compatible with the screw 74. In the embodiment shown in FIG. 5, the screws 74 are force fit into male and female openings, 74 and 76 respectively.

The screws 74 and cooperating structure allow the collisions to occur with greatly ferocity and more frequently. The screws 74 provide additional security for such collisions and rollovers and the like. It will be appreciated that other forms of attachment not specifically mentioned herein are equally within the spirit and, scope of the invention and that the specific structure may be conventional or novel as long as the function of remaining connected during PCV operation is achieved.

While the foregoing detailed description has described several embodiments of the cleaning structure in accordance with this invention, it is to be understood that the above description is illustrative only and not limiting of the disclosed invention. Particularly, there are varieties of different combinations of inserts and tracks and even wheels and/or rollers that can be used successfully with the cleaning structure in accordance with this invention. Each such combination, although not specifically recited and described above is within the spirit and scope of this invention. It also will be appreciated that there are various modifications to the track and cleaning structure are also within the spirit and scope of the invention herein and that of particular interest is the ability of the cleaning structure to dislodge dirt and debris using the side of the drive wheels, rollers or tracks in order for the same to be sucked up and removed from the pool during PCV operation. Thus, the invention is to be limited only by the claims as set forth below.

What is claimed is:

1. A cleaning structure attachable to a submersible pool cleaning vehicle (PCV), the vehicle including a housing and the housing including members for moving the vehicle around the pool surface, the vehicle with the cleaning structure, comprising:

the members for moving the vehicle around the pool surface defining an endless loop track; a chassis for the endless loop track, the chassis having an exterior and an interior; a detachable cleaning insert attachable to the chassis for the endless loop track, the cleaning insert defining a plurality of bristles, the bristles outwardly extending from the endless loop track, the cleaning insert defining a single member which is attachable to the endless loop track; and means for connecting the cleaning insert to the chassis for the endless loop track; whereby, as PCV moves around the pool surface the bristles contact the surface of the pool and dislodge dirt and debris to facilitate thorough cleaning of the pool; and means for connecting the cleaning insert to the endless loop track including the chassis having a race associated with the exterior surface of the track and the single member of the cleaning insert having a compatible race for force fit connection with the track race.

2. The cleaning insert as set forth in claim 1, wherein the cleaning insert defines a plurality of members which are attachable to the endless loop track.

3. The cleaning insert as set forth in claim 2, wherein the means for connecting the each cleaning insert to the endless loop track includes the endless loop female connectors and each cleaning insert having male connectors, which form a friction fit with the female connector.

4. The cleaning insert as set forth in claim 1, wherein the bristles of the cleaning insert define fingers and wherein each of the fingers are of the same length.

5. The cleaning insert as set forth in claim 1, wherein the bristles of the cleaning insert define fingers and wherein each of the fingers are of graduated lengths and wherein the longest fingers are along the centerline of the insert.

6. A submersible pool cleaning vehicle (PCV) including cleaning inserts attachable to the PCV, the PCV with cleaning inserts comprising:

a housing;

the housing including a chassis;

means for moving the PCV connected to the chassis, the chassis having an exterior and an interior;

cleaning inserts, attachable to the means for moving the PCV, the cleaning inserts including a base and fingers extending outwardly from the base, the cleaning inserts defining a plurality bristles, the bristles outwardly extending from the endless loop track;

means for connecting the cleaning insert to the means for moving the PCV chassis, the base is force fit on the means for moving the PCV, whereby, as the PCV moves around the pool surface the bristles contact the surface of the pool and dislodge dirt and debris to facilitate thorough cleaning of the pool.

7. The PCV with cleaning inserts as set forth in claim 6, wherein the means for moving the PCV comprises an endless loop track.

8. The PCV with cleaning inserts as set forth in claim 6, wherein there are two cleaning inserts for the PCV, one for either side of the PCV and each insert proximate to the means for moving the vehicle.

9. The PCV with cleaning inserts as set forth in claim 6, wherein the chassis for the means for moving the PCV is modified to accept multiple cleaning inserts and wherein the PCV includes multiple cleaning inserts, each insert capable of being force fit into the chassis, proximate the means for moving the PCV.

10. The PCV with cleaning inserts as set forth in claim 9, wherein the chassis for the means for moving the PCV is modified to accept 4 circular cleaning inserts on each side of the PCV and wherein the PCV includes 4 circular cleaning inserts for both sides of the PCV, and wherein each insert is capable of being force fit into the chassis, proximate the means for moving the PCV.

* * * * *